US006433746B2

(12) United States Patent
Kushihi et al.

(10) Patent No.: US 6,433,746 B2
(45) Date of Patent: Aug. 13, 2002

(54) ANTENNA SYSTEM AND RADIO UNIT USING THE SAME

(75) Inventors: Yuichi Kushihi; Kazuhisa Yamaki, both of Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/872,101

(22) Filed: Jun. 1, 2001

(30) Foreign Application Priority Data

Jun. 15, 2000 (JP) ..... 2000-179980

(51) Int. Cl.[7] ..... H01Q 1/36; H01Q 1/24
(52) U.S. Cl. ..... 343/700 MS; 343/702
(58) Field of Search ..... 343/700 MS, 702, 343/841, 846, 848; 455/89, 90

(56) References Cited

U.S. PATENT DOCUMENTS 5,861,854 A * 1/1999 Kawahata et al. ... 343/700 MS
6,281,848 B1 * 8/2001 Nagumo et al. ..... 343/700 MS
6,300,909 B1 * 10/2001 Tsubaki et al. ..... 343/700 MS

* cited by examiner

*Primary Examiner*—Tan Ho
(74) *Attorney, Agent, or Firm*—Ostrolenk, Faber, Gerb & Soffen, LLP

(57) ABSTRACT

A reduced thickness radio unit without deteriorating antenna performance is disclosed. A metallic plate performing radio wave transmission/reception together with the radiation electrode, is conductively connected to the radiation electrode of a surface-mount type antenna. The metallic plate is preferably disposed so as to be opposed to the outer long-side surface of the substrate of the surface-mount type antenna with a space therebetween. Therefore, when mounting the metallic metal on a circuit board of the radio unit, the metallic plate does not face the circuit board surface and the top surface of a shield case, which are equivalent to ground. By thus disposing the metallic plate substantially perpendicularly to the circuit board, the problem of increase in electrostatic capacitance between the metallic plate and ground can be avoided, the increase in electrostatic capacitance being due to the reduction in thickness of the radio unit.

7 Claims, 4 Drawing Sheets

ANTENNA SYSTEM AND RADIO UNIT USING THE SAME

BACKGROUND OF THE INVENTION

1. Field of the Invention

The present invention relates to an antenna system mounted on a radio unit such as a portable telephone, and to a radio unit using this antenna system.

2. Description of the Related Art

FIG. 4 is a schematic perspective view showing an example of a surface-mount type antenna. The surface-mount type antenna 1 shown in FIG. 1 has a rectangular-parallelepiped shaped substrate 2 which is formed of a dielectric body. A radiation electrode 3 is formed on the top surface 2*a* of this substrate 2. The left end side (shown in FIG. 4) of the radiation electrode 3 is extended to a side surface 2*b* of the substrate 2, and the left end 3*a* of the radiation electrode 3 forms an open (unconnected) end. On a side surface 2*c* of the substrate 2, a feeding electrode 4 is extended from the bottom side toward the upper side, and is connected continuously to the right end portion of the radiation electrode 3, wrapping around the top surface 2*a* of the substrate 2.

Such a surface-mount type antenna 1 is mounted on a circuit board, using the bottom surface 2*d* of the substrate 2 as a mounting surface, and is conductively connected to a radio unit circuitry 5 formed on the circuit board, via the feeding electrode 4. With the radiation electrode 3 and the radio unit circuitry 5 thus conductively connected, for example, when a signal is supplied by the radio unit circuitry 5 to the radiation electrode 3 through the feeding electrode 4, the radiation electrode 3 is excited by the signal, and the signal (radio wave) is transmitted to the outside. On the other hand, when a signal is received, the signal flows in the direction opposite to that during the above-described transmission, and the received signal is supplied to the radio unit 5. In this manner, the surface-mount type antenna 1 performs an antenna operation of transmitting/receiving the signal (radio wave).

Meanwhile, the frequency band is determined by the effective line length of the signal of the radiation electrode 3. Conversely, the effective line length of the signal of the radiation electrode 3 is determined in accordance with the frequency band of the radio wave transmission/reception based upon a given specification. With the miniaturization of radio units, there is a need also to miniaturize surface-mount type antennas 1 as described above. As the frequency band of the radio wave transmission/reception required for the surface-mount type antennas 1 becomes low, the effective line length of the signal of the radiation electrode 3 must be set to be long, but it can be difficult to ensure a long effective line length in order to perform radio wave transmission/reception in a desirable low frequency band, due to the miniaturization of the surface-mount type antennas 1.

Accordingly, an antenna system 7 as shown in FIG. 5 has been proposed. In FIG. 5, the antenna system 7 is shown as being mounted on a circuit board 11 of a radio unit 10 such as a portable telephone. The antenna system 7 shown in FIG. 5, comprises a surface-mount type antenna 1 as described above which constitutes a surface-mount type antennas portion, and a metallic plate 8 which is conductively connected to the radiation electrode 3 of the surface-mount type antenna 1. In this antenna system 7, by conductively connecting the metallic plate 8 to the radiation electrode 3, the effective line length of the signal of the radiation electrode 3 is equivalently elongated by the increment of the installed metallic plate 8. This facilitates the transmission/reception of radio waves at a required low frequency.

The antenna system 7 is mounted on a circuit board 11 of a radio unit, for example, in an installation configuration as shown in FIG. 5. Specifically, radio unit circuits (5) such as a signal processing circuit and a controlling circuit, are formed on the circuit board 11, and a shield case 13 for shielding these radio unit circuits is provided on this circuit board 11. The top surface of the shield case 13 is parallel with the surface of the circuit board 11 and the top surface 2*a* and the bottom surface 2*d* of the substrate 2 of the surface-mount type antenna 1. The surface-mount type antenna 1 of the antenna system 7 is mounted on the circuit board 11 in the vicinity of the shield case 13, using the bottom surface 2*d* of the substrate 2 of the surface-mount type antenna 1 as a mounting surface. The metallic plate 8 of the antenna system 7 is disposed above the shield case 13 with a space therebetween so that the surface of the metallic plate 8 is parallel with the top surface of the shield case 13.

The circuit board 11 on which the antenna system 7 and the radio unit circuits are provided, are housed in, for example, a case 12 as shown by a chain line in FIG. 5. When the radio unit 10 is a portable telephone, a battery for power in the radio unit is disposed on the blank portion on the circuit board 11 as shown in FIG. 5.

Meanwhile, there is now increased demand for a radio unit 10 such as a portable telephone which has a reduced thickness D. In order to reduce the thickness the radio unit 10, the spacing between the metallic plate 8 of the antenna system 7 and the top surface of the shield case 13 must be made very narrow. However, the entire surface of the metallic plate 8 is opposed to the top surface of the shield case 13 with a space therewith, and the shield case 13 and the surface of the circuit board 11 are equivalent to the ground, and hence, by reducing the spacing between the metallic plate 8 and the shield case 13 as described above, the electrostatic capacitance between the metallic plate 8 and the shield case 13, in other words, the electrostatic capacitance between the metallic plate 8 and the ground, significantly increases. This increase in the capacitance causes problems such as a reduction in the antenna gain, and the narrowing of the frequency bandwidth of radio wave transmission/reception.

SUMMARY OF THE INVENTION

It is an object of the present invention to solve the above-described problems. It is, furthermore, an object of the invention to provide an antenna system capable of meeting the demands for the transmission/reception of lower frequency radio waves, and capable of reducing the thickness of a radio unit without deteriorating antenna performance, and also to provide a radio unit using this antenna system.

In order to achieve the above-described objects, the present invention provides, in a first aspect, a surface-mount type antenna which comprises a surface-mount type antenna portion which is configured by forming, on a substrate, a radiation electrode for radio wave transmission/reception, and a metallic plate which is conductively connected to the radiation electrode of the surface-mount type antenna portion, and which performs radio wave transmission/reception together with the radiation electrode. The surface-mount type antenna portion is mounted on a circuit board of a radio unit, using the bottom surface of the substrate as a mounting surface, and the metallic plate is provided so as to be isolated from the circuit board. The metallic plate is preferably disposed adjacent to the long-side surface of the substrate of the surface-mount type antenna portion with a space therebetween so that the surface of the metallic plate is non-parallel with the bottom surface of the surface-mount type antenna portion.

The present invention provides, in a second aspect, a radio unit which includes an antenna system in accordance with the above-described first aspect.

In the radio unit in accordance with the second aspect, it is preferable that the metallic plate of the antenna system be disposed so that the surface thereof is opposed to the corresponding end surface of a circuit board with a spacing therebetween.

In the present invention having the above-described features, the metallic plate of the antenna system is disposed adjacent to the outer long-side surface of the substrate of the surface-mount type antenna portion with a space therebetween so that the surface of the metallic plate is non-parallel with the bottom surface of the surface-mount type antenna portion. When mounting the surface-mount type antenna portion on a circuit board of a radio unit, using the bottom surface of the substrate as a mounting surface, the metallic plate becomes non-parallel with the surface of the circuit board surface, which is equivalent to ground.

Thereby, the occurrence of a large electrostatic capacitance between the metallic plate and the circuit board (that is, ground) can be prevented, and hence, the problem of the increase in electrostatic capacitance between the metallic plate and the ground can be avoided, the increase in the electrostatic capacitance being due to the reduction in thickness of the radio unit. This facilitates achieving a reduction in thickness of the radio unit while preventing the deterioration of the antenna performance.

The above and other objects, features, and advantages of the present invention will be clear from the following detailed description of the preferred embodiments of the invention in conjunction with the accompanying drawings.

DETAILED DESCRIPTION OF EMBODIMENTS OF THE INVENTION

Figure 1:
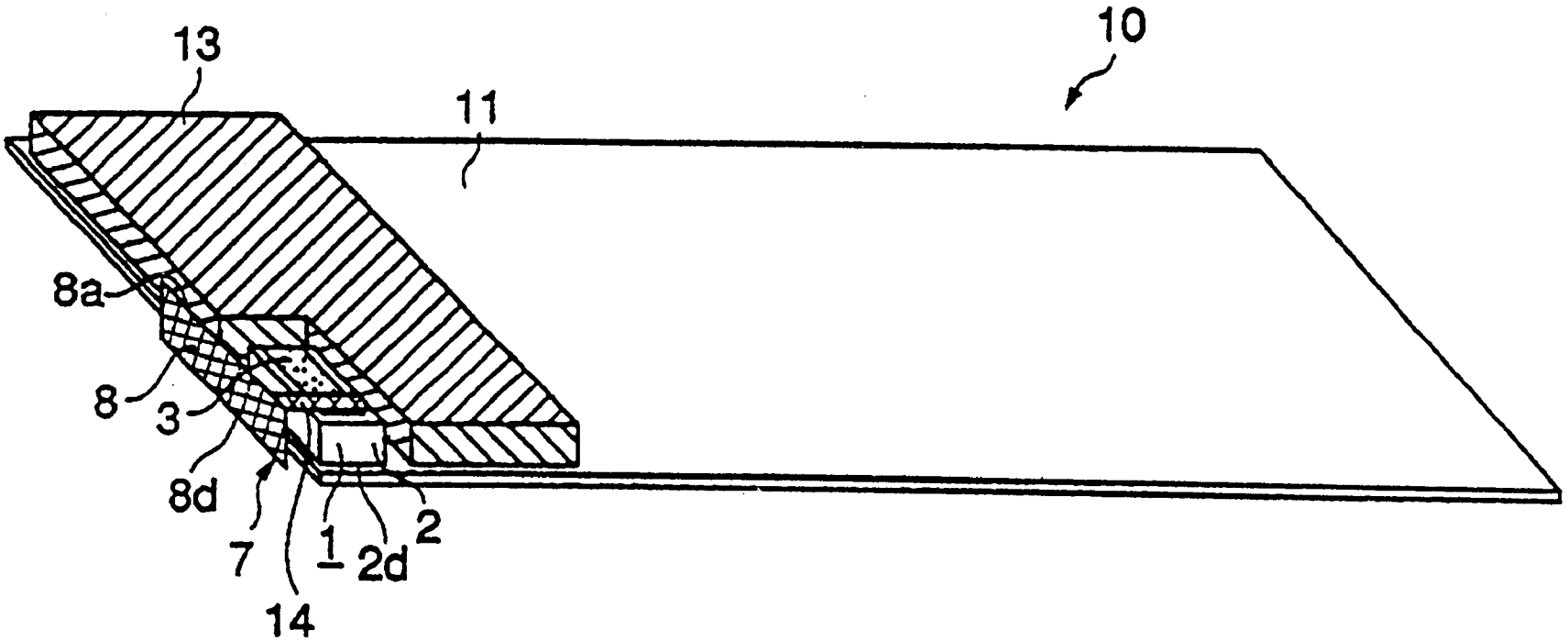
FIG. 1 is a perspective view for explaining an antenna system and a radio unit in accordance with an embodiment of the present invention.

FIG. 1 shows a radio unit in accordance with an embodiment of the present invention, together with an antenna system in accordance with an embodiment thereof. In the descriptions of this embodiment, the same components as those of the antenna system and the radio unit shown in FIG. 5 have been given the same reference numerals, and repeated descriptions of the components in common therebetween will be omitted. The radio unit 10 shown in this embodiment is also provided with a case 12 as shown in FIG. 5, but the illustration of the case is omitted in FIG. 1.

Figure 4:
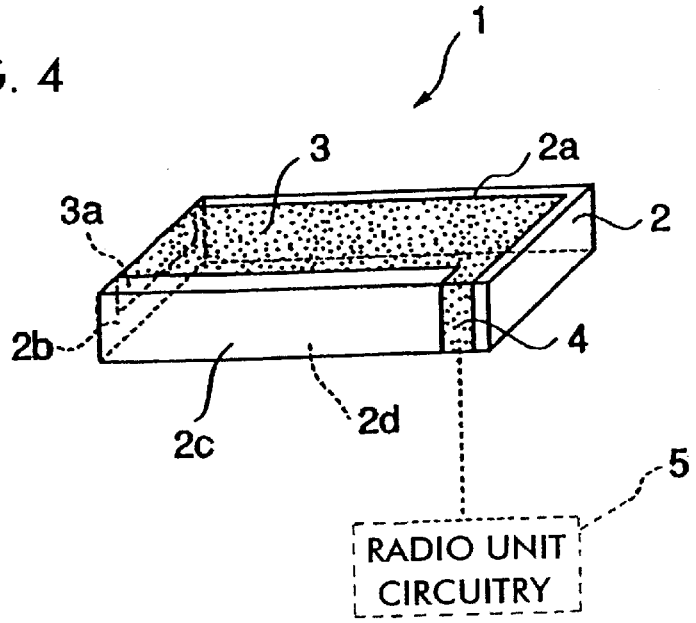
FIG. 4 is a perspective view for explaining an example of a surface-mount type antenna.
Figure 5:
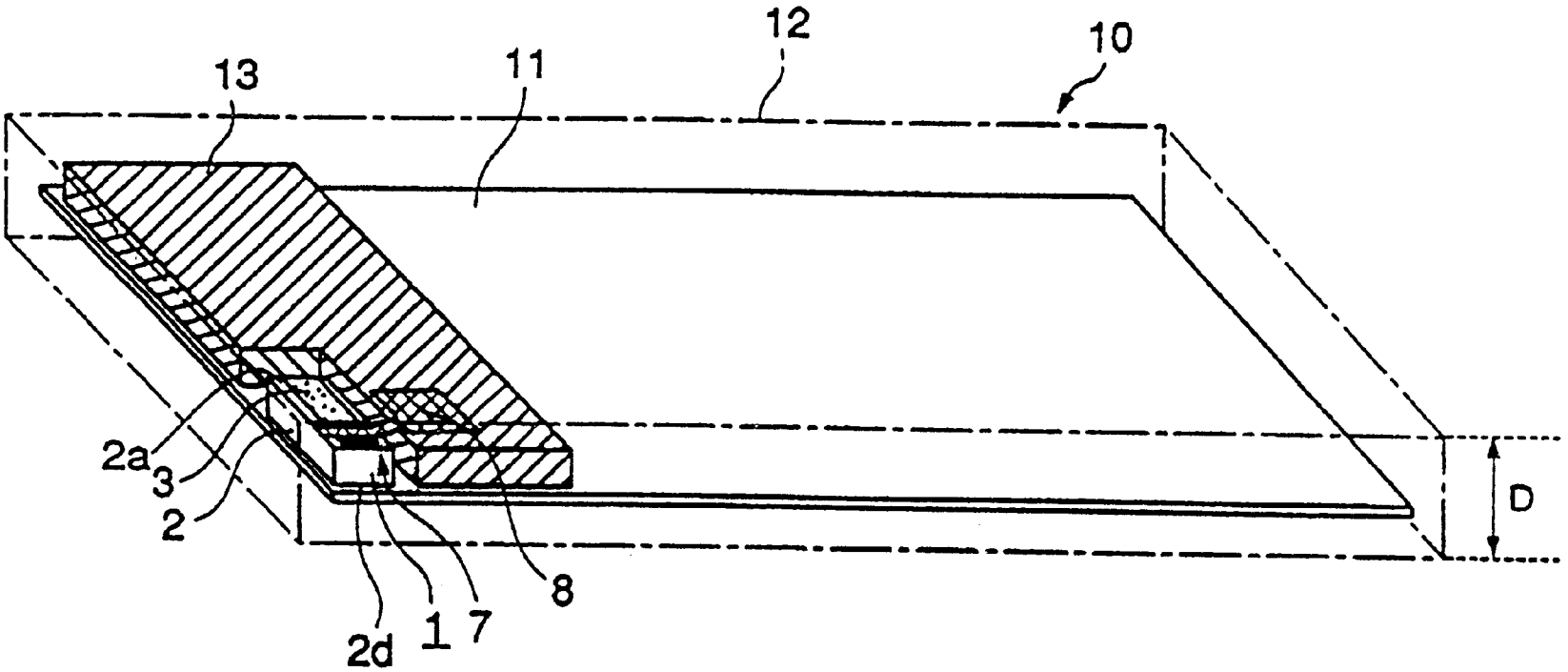
FIG. 5 is a perspective view for explaining a proposed example of an antenna system which has a surface-mount type antenna portion and a metallic plate.

As illustrated in FIG. 1, the antenna system 7 in accordance with this embodiment comprises a surface-mount type antenna 1 which constitutes a surface-mount type antenna portion as in the case of the antenna system 7 shown in FIG. 5, and a metallic plate. The difference between the antenna system in accordance with this embodiment and the antenna system shown in FIG. 5 is characterized by the installation relation between the above-described surface-mount type antenna 1 and the metallic plate 8. Specifically, in this embodiment, the metallic plate 8 is disposed adjacent to the outer long-side surface of the substrate 2 of the surface-mount type antenna 1 with a space therebetween so that the surface of the metallic plate 8 is substantially parallel with the side surface of the substrate 2. In this embodiment, the surface-mount type antenna 1 may have various configurations, but herein, descriptions will be given, taking the surface-mount type antenna 1 shown in FIG. 4 as an example.

In this embodiment, a metallic plate member for connection 14 is extended in the direction perpendicular to the plane of the metallic plate 8 from the upper end 8*a* (shown in FIG. 1) of the metallic plate 8, and the extending tip of the metallic plate member for connection 14 is bonded to the radiation electrode 3 of the surface-mount type antenna 1, using solder or a conductive adhesive. The radiation electrode 3 and the metallic plate 8 are thereby conductively connected. The upper end portion 8*a* of the metallic plate 8 is disposed substantially flush with the top surface of the substrate 2 of the surface-mount type antenna 1.

As shown in FIG. 1, the radio unit 10 in accordance with this embodiment is provided with the antenna system 7 which has the above-described peculiar feature at the outer edge region of the circuit board 11. More specifically, the surface-mount type antenna 1 of the antenna system 7 is mounted at the outer edge region of the circuit board 11, using the bottom surface 2*d* of the substrate 2 as a mounting surface. The metallic plate 8 lies off the circuit board 11, that is, the metallic plate 8 is disposed so as to be isolated from the circuit board, with a space interposed therebetween.

In this embodiment, as shown in FIG. 1, the lower end 8*d* of the metallic plate is located at a lower position than the bottom surface 2*d* of the substrate 2 of the surface-mount type antenna 1, and more specifically, for example, substantially at a position on the same level with the rear surface of the circuit board 11, or a position slightly projecting downward with respect to the rear surface, that is, a position lower than the top portion of the tallest component of the components provided on the rear surface. As a result, the surface of the metallic plate 8 becomes opposed not only to the outer long-side surface of the substrate 2 but also to the corresponding end surface of the circuit board 11, with a space therebetween.

As described above, in this embodiment, the upper end 8*a* of the metallic plate 8 is on the same level as the top surface of the substrate 2 of the surface-mount type antenna 1, and the lower end 8*d* of the metallic plate 8 is on the same level as the rear surface of the circuit board 11, or slightly projecting downward with respect to the rear surface. Thus, the width in the height direction of the metallic plate 8 is small, and as shown in FIG. 1, the metallic plate 8 preferably has a narrow rectangular shape. In this manner, by reducing the width in the height direction of the metallic plate 8, the end portion of the metallic plate 8 is prevented from projecting in the vertical direction (shown in FIG. 1) with respect to the other components of the radio unit 10. In other words, the metallic plate 8 has a configuration not hindering the reduction in thickness of the radio unit 10.

As illustrated in FIG. 1, in this embodiment, although one portion of the metallic plate 8 is opposed to the corresponding side surface of the shield case 13 with a space therebetween, the spacing between the metallic plate 8 and the corresponding side surface of the shield case 13 is set to be sufficiently wide to prevent the occurrence of the problem of the increase in electrostatic capacitance between the metallic plate 8 and the ground.

In accordance with this embodiment, as in the case of the above-described proposed example, since the antenna system 7 is formed by conductively connecting the metallic plate 8 to the radiation electrode 3 of the surface-mount type antenna 1, the effective line length of the signals of the radiation electrode 3 can be equivalently elongated. This facilitate obtaining an antenna system 7 capable of transmitting/receiving low-frequency radio waves, which is difficult to be obtained by the radiation electrode 3 alone. One possible means for equivalently elongating the effective line length of the signals of the radiation electrode 3 without utilizing the metallic plate 8, is to connect an inductance component in series with the radiation electrode 3. This, however, creates a problem that the antenna sensitivity is deteriorated by the inductance component. In contrast, like this embodiment, if the effective line length of signals is equivalently elongated by the conductively connecting the metallic plate 8 to the radiation electrode 3, there will be no risk of deterioration of antenna sensitivity, and transmission/reception of radio waves at a required low frequency can be performed with a high sensitivity.

Also, since the metallic plate 8 is disposed adjacent to the outer long-side surface of the substrate 2 of the surface-mount type antenna 1 with a space therebetween so that the surface of the metallic plate is substantially parallel with the outer long-side surface of the substrate 2, the metallic plate 8 becomes substantially perpendicular to the surface of the circuit board 11 and the top surface of the shield case 13 when the antenna system 7 is mounted on the circuit board 11 of the radio unit 10 in the embodiment shown in FIG. 1. As a result, the occurrence of a large electrostatic capacitance between the surface of the circuit board or the top surface of the shield case 13 and the metallic plate 8 can be prevented. It becomes, thereby, possible to avoid the problem of the increase in electrostatic capacitance between the metallic plate 8 and ground due to the above-described reduction in thickness of the radio unit 10, and to achieve the slimness of the radio unit 10 without the need to worry about the reduction in antenna gain and the narrowing of bandwidth.

This fact has been confirmed in the following experiments by the present inventors. First, an antenna system 7 in accordance with the above-described proposed example as shown in FIG. 5, and an antenna system 7 having a configuration according to this embodiment were prepared. Next, the antenna system 7 in accordance with the proposed example was disposed on the circuit board 11 of the radio unit 10 in a mounting configuration as shown in FIG. 4, and then the antenna system 7 shown in this embodiment was disposed on the circuit board 11 of the radio unit 10 in a mounting configuration as shown in FIG. 1. Upon setting other conditions such as the thickness of the case of the radio unit to be equal, antenna gains and bandwidths were compared between these antenna units 7 of the proposed example and the embodiment. Table 1 shows the experimental results.

TABLE 1

| | Antenna gain [dBd] | | Center | |
|---|---|---|---|---|
| | Peak gain | Average gain | frequency [MHZ] | Bandwidth [MHZ] |
| Embodiment | −3.3 | 6.7 | 820 | 40 |
| Proposed example | −6.0 | −10.0 | 823 | 36 |

As can be seen from the results in Table 1, the antenna system 7 having a configuration in accordance with this embodiment exhibits a significant improvement in the antenna gain and an enlargement in the bandwidth, relative to the antenna system 7 in accordance with the proposed example.

In this way, providing the antenna system 7 having a configuration according to this embodiment suppresses the deterioration of the antenna performance such as the antenna gain and the bandwidth, and allows the slimming of the radio unit 10 to be achieved.

Meanwhile, the present invention is not limited to the above-described embodiment, but various embodiments may be adopted. For example, in the above-described embodiment, although the metallic plate 8 is disposed substantially parallel with the outer long-side surface of the substrate 2 of the surface-mount type antenna 1, the metallic plate 8 has only to be disposed non-parallel with the bottom surface of the substrate 2, that is, the metallic plate 8 may be disposed so as to be tilted with respect to the outer long-side surface of the substrate 2.

Also, in the above-described embodiment, the metallic plate member for connection 14 for the metallic plate 8 and the radiation electrode 3 are bonded using solder or a conductive adhesive. However, the metallic plate 8 and the radiation electrode 3 only need to be conductively connected, and hence, the metallic plate 8 and the radiation electrode 3, for example, have only to be in contact without bonding them, or may be made integral, for example.

Moreover, in the above-described embodiment, the lower end 8*d* of the metallic plate 8 is located lower than the bottom surface 2*d* of the substrate 2 of the surface-mount type antenna 1, but may be located on the same level with the bottom surface 2*d* of the substrate 2, or higher than the bottom surface 2*d*. Also, in the above-described embodiment, the metallic plate 8 is disposed so as to lie off the circuit board 11, but may be disposed above the circuit board 11 with a space therebetween.

Figure 2A:
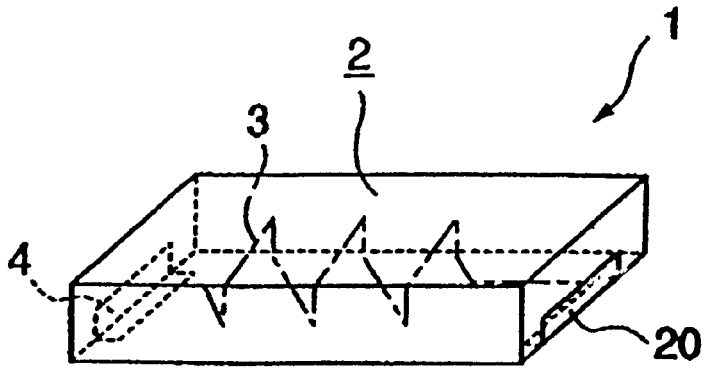
FIGS. 2A and 2B are perspective views for explaining a modification of a surface-mount type antenna portion.
Figure 2B:
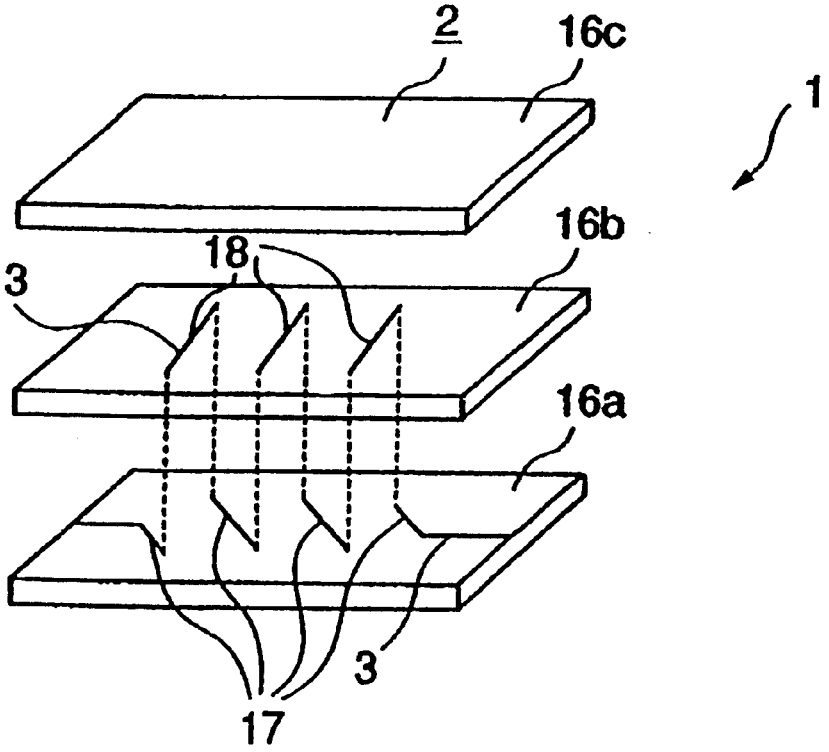

In the above-described embodiment, descriptions have been given taking a surface-mount type antenna 1 as shown in FIG. 4, as an example, but the configuration of the surface mount type antenna portion constituting an antenna system in accordance with the present invention is not restricted to that of the surface-mount type antenna shown in FIG. 4. The surface-mount type antenna portion may have various configurations. For example, a surface-mount type antenna as shown in FIG. 2A may be adopted. FIG. 2B is an exploded view of the surface-mount type antenna shown in FIG. 2A.

The surface-mount type antenna 1 shown in FIGS. 2A and 2B has a substrate 2 which is formed by integrally laminating sheet layers 16*a*, 16*b*, and 16*c* constituted of a dielectric material. Within this substrate 2, a radiation electrode 3 formed into a spiral shape is disposed. Specifically, on the top surface of each of the sheet layers 16*a* and 16*b* constituting the substrate 2, conductive patterns 17 and 18 for forming the above-described radiation electrode 3 are formed, respectively. The conductive pattern 17 formed on the sheet layer 16*a* and the conductive pattern 18 formed on the sheet layer 16*b* are conductively connected via a through hole formed through the sheet layer 16*b,* thereby forming the spiral-shaped radiation electrode 3.

A feeding electrode 4 is formed on the left side surface (shown in FIG. 2A) of the substrate 2, and a free terminal portion 20 is formed on the right side surface shown in FIG. 2A. One end side of the radiation electrode 3 is conductively connected to the above-described feeding electrode 4, while the other end of the radiation electrode 3 is conductively connected to the free terminal portion 20.

Figure 3A:
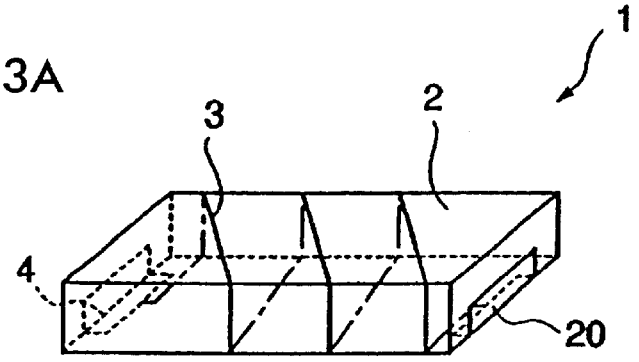
FIGS. 3A and 3B are perspective views for explaining other modifications of surface-mount type antenna portions.

Furthermore, a surface-mount type antenna 1 as shown in FIG. 3A may be adopted. The surface-mount type antenna 1 shown in FIG. 3A is such that the radiation electrode 3 is configured by forming spiral-shaped conductor patterns on the top surface, the front side-surface, the bottom surface, and the rear side-surface of the substrate 2. As in the case of the surface-mount type antenna 1 shown in FIGS. 2A and 2B, one end side of the radiation electrode 3 is conductively connected to the feeding electrode 4 formed on the left side-surface of the substrate 2, while the other end of the radiation electrode 3 is conductively connected to the free terminal portion 20 formed on the right side-surface of the substrate 2.

Figure 3B:
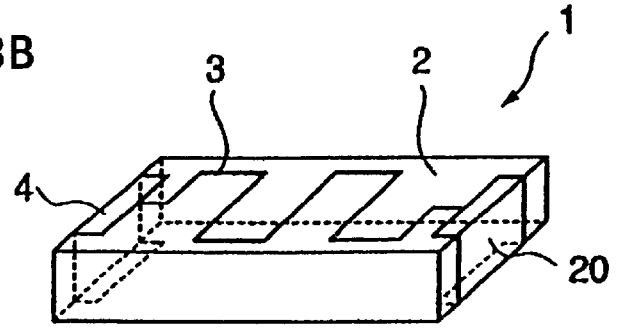

Moreover, a surface-mount type antenna 1 as shown in FIG. 3B may be adopted. The surface-mount type antenna 1 shown in FIG. 3B is such that the radiation electrode 3 is configured by forming meander-shaped conductor patterns on the top surface of the substrate 2. As in the case of the surface-mount type antenna 1 shown in FIGS. 2A, 2B, and FIG. 3A, one end side of the radiation electrode 3 is conductively connected to the feeding electrode 4 formed on the substrate 2, while the other end side of the radiation electrode 3 is conductively connected to the free terminal portion 20 formed on the substrate 2.

Each of the surface-mount type antennas 1 shown in FIGS. 2A and 2B, and FIGS. 3A and 3B can also perform the function similar to that of surface-mount type antenna 1 in accordance with the above-described embodiment, by mounting the surface-mount type antenna 1 on the circuit board 11 of the radio unit 10, and conductively connecting the radio unit 5 to the above-described feeding electrode 4.

By utilizing a surface-mount type antenna 1 as described above, a similar antenna system to the above-described embodiment can be configured. Specifically, a metallic plate is conductively connected to the free terminal portion 20 of each of the surface-mount type antennas 1 shown in FIGS. 2A and 2B, and FIGS. 3A, 3B, and the radiation electrode 3 and the metallic plate are conductively connected via the free terminal portion 20. Herein, the metallic plate is disposed adjacent to the outer long-side surface of the substrate with a space therebetween so as to be non-parallel with the bottom surface 2*d* of the substrate 2. By configuring the antenna system in this manner, a superior effect can be exerted as in the case of the above-described embodiment.

In addition, in the above-described embodiment, the substrate 2 constituting a surface-mount type antenna 1 is formed of a dielectric body, but the substrate may instead be formed of, for example, a magnetic body.

As is evident from the foregoing, in accordance with the present invention, since the metallic plate to be conductively connected to the radiation electrode of the surface-mount type antenna portion is disposed adjacent to the outer long-side surface of the substrate of the surface-mount type antenna portion with a space therebetween so that the surface of the metallic plate is non-parallel with the bottom surface of the surface-mount type antenna portion, it is possible to prevent an occurrence of a large electrostatic capacitance between the surface of the circuit board surface, which is equivalent to ground, and the metallic plate, when mounting the surface-mount type antenna portion of the antenna system on the circuit board using the bottom surface of the substrate as a mounting surface. Thereby, the reduction in antenna gain and the narrowing of bandwidth due to the increase in electrostatic capacitance between the metallic plate and ground can be prevented.

In accordance with the radio unit of the present invention, since an antenna system having the described features is provided in this radio unit, a reduction in the thickness of the radio can be achieved without a corresponding reduction in antenna gain and narrowing of bandwidth.

In the radio unit in accordance with the present invention, wherein the metallic plate of the antenna system thereof is disposed so that the surface thereof is opposed to the corresponding end surface of the circuit board with a space therebetween, the metallic plate and the surface of the circuit board do not face each other, and hence, it is possible to reduce the problem of the increase in electrostatic capacitance between the metallic plate and ground, and to achieve a low-profile radio unit which has a superior antenna gain, and which allows widening of the frequency band of radio wave transmission/reception to be achieved.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. An antenna system, comprising:

a surface-mount type antenna portion which is configured by forming a radiation electrode for radio wave transmission/reception on a substrate; and a metallic plate which is conductively connected to said radiation electrode of said surface-mount type antenna portion, and which performs radio wave transmission/reception together with said radiation electrode, wherein:

said surface-mount type antenna portion is mounted on a circuit board of a radio unit, using a bottom surface of said substrate as a mounting surface;

said metallic plate is provided so as to be isolated from said circuit board; and said metallic plate is disposed adjacent to an outer side surface of said substrate of said surface-mount type antenna portion with a space there between so that the surface of said metallic plate is non-parallel with the bottom surface of said surface-mount type antenna portion.

2. The antenna system of claim 1, wherein the substrate has a long and a short side surface, a side surface of the substrate adjacent the metallic plate comprising the long side surface.

3. The antenna system of claim 1, wherein the circuit board has two major surfaces, the metallic plate being arranged adjacent an end surface of the circuit board disposed between the two major surfaces of the circuit board.

4. A radio unit comprising an antenna system, the antenna system comprising:

a surface-mount type antenna portion which is configured by forming a radiation electrode for radio wave transmission/reception on a substrate; and a metallic plate which is conductively connected to said radiation electrode of said surface-mount type antenna portion, and which performs radio wave transmission/reception together with said radiation electrode, wherein:

said surface-mount type antenna portion is mounted on a circuit board of a radio unit, using a bottom surface of said substrate as a mounting surface;

said metallic plate is provided so as to be isolated from said circuit board; and said metallic plate is disposed adjacent to an outer side surface of said substrate of said surface-mount type antenna portion with a space there between so that the surface of said metallic plate is non-parallel with the bottom surface of said surface-mount type antenna portion.

5. The radio unit of claim 4, wherein the substrate has a long and a short side surface, a side surface of the substrate adjacent the metallic plate comprising the long side surface.

6. The radio unit of claim 4, wherein the circuit board has two major surfaces, the metallic plate being arranged adjacent an end surface of the circuit board disposed between the two major surfaces of the circuit board.

7. The radio unit of claim 4, wherein the metallic plate of said antenna system is disposed so that a surface thereof is opposed to a corresponding end surface of a circuit board with a space therebetween.

* * * * *